United States Patent [19]

Greiner et al.

[11] Patent Number: 4,826,082

[45] Date of Patent: May 2, 1989

[54] FUEL INJECTION VALVE

[75] Inventors: Max Greiner, Gerlingen; Udo Hafner, Lorch; Waldemar Hans, Bamberg; Heinrich Knapp, Leonberg; Wolfgang Kramer, Kemmern; Rudolf Krauss, Stuttgart; Ferdinand Reiter, Markgroningen; Peter Romann, Stuttgart; Rudolf Sauer, Benningen, all of Fed. Rep. of Germany

[73] Assignee: Robert Bosch GmbH, Stuttgart, Fed. Rep. of Germany

[21] Appl. No.: 134,266

[22] Filed: Dec. 17, 1987

[30] Foreign Application Priority Data

Feb. 6, 1987 [DE] Fed. Rep. of Germany ..... 3703615

[51] Int. Cl.[4] ..... F02M 51/06

[52] U.S. Cl. ..... 239/113; 239/125; 239/132.5; 239/585

[58] Field of Search ..... 239/585, 124, 125, 104, 239/106, 113, 132, 132.3, 132.5; 251/129.15

[56] References Cited

U.S. PATENT DOCUMENTS 4,215,820 8/1980 Renger ..... 239/585
4,700,891 10/1987 Hans et al. ..... 239/132.5

FOREIGN PATENT DOCUMENTS 2171758 9/1986 United Kingdom ..... 239/585

*Primary Examiner*—Andres Kashnikow
*Assistant Examiner*—Karen B. Merritt
*Attorney, Agent, or Firm*—Edwin E. Greigg

[57] ABSTRACT

An electromagnetically actuatable fuel injection valve which has an internal scavenging system for cleaning dirt particles from a magnetic field air gap. A portion of the fuel flowing in via an inflow line and an inflow opening reaches the vicinity of an air gap defined on one side by an armature and on the other by magnetic poles and flows through this gap, and then flows via an outflow opening to enter an outflow line that communicates with a fuel return. As a result of the described scavenging of the air gap, dirt particles are prevented from becoming firmly attached there and causing impairment of the performance of the fuel injection valve.

17 Claims, 1 Drawing Sheet

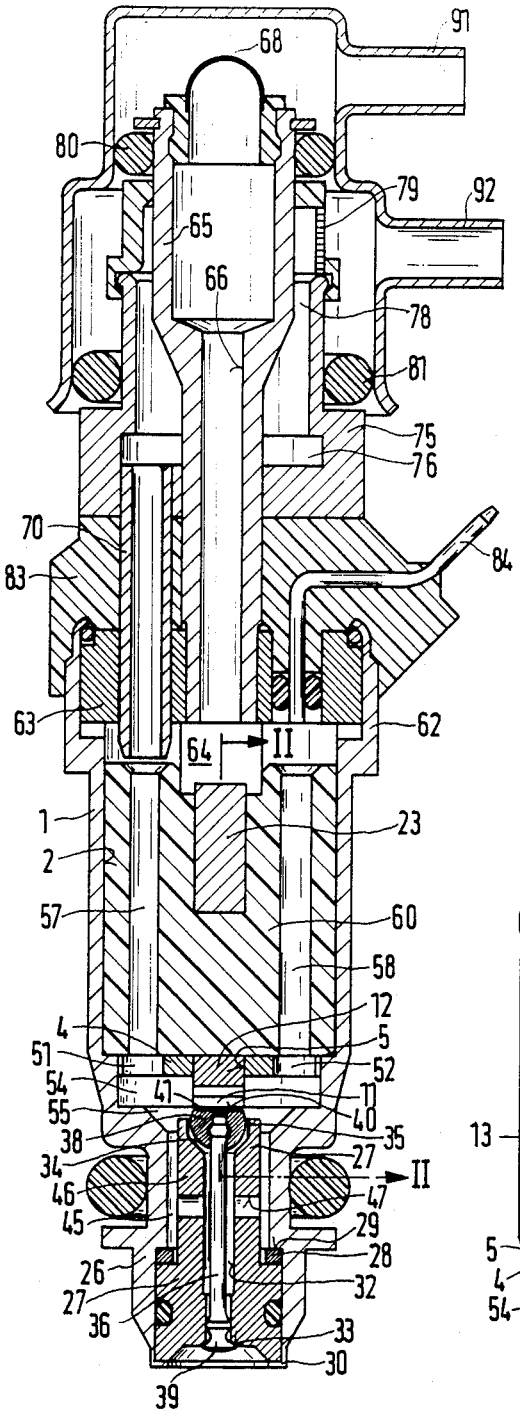
Fig. 1
Fig. 2
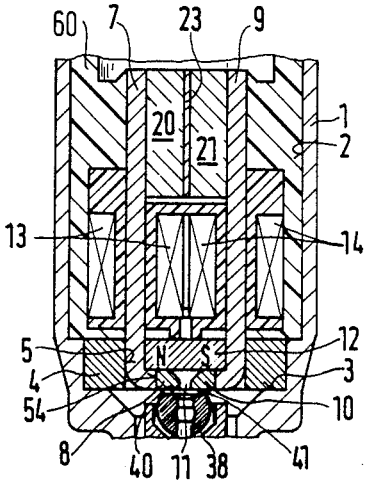

FUEL INJECTION VALVE

RELATED INVENTION

This invention is related to application Ser. No. 822,520 filed Jan. 27, 1986, now U.S. Pat. No. 4,704,591; and to application Ser. No. 831,748 filed Feb. 21, 1986, now U.S. Pat. No. 4,653,720.

BACKGROUND OF THE INVENTION

The invention is based on a fuel injection valve as defined hereinafter. A fuel injection valve is already known which when the magnet coil is not excited attracts the armature toward the magnetic poles by means of a magnetic field maintained by a permanent magnet. In this situation, it is unavoidable that dirt particles dissolved in the fuel will also come under the influence of the magnetic field and be deposited on the surface of the poles. This causes a change in the thickness of the air gap between the armature and the pole surfaces, and moreover, magnetic stray fluxes can arise. This results in an undesirable variation in the dynamic behavior of the fuel injection valve, for example in terms of the duration of the transition time between an opening and a closing of the valve.

OBJECT AND SUMMARY OF THE INVENTION

The fuel injection valve according to the invention has the advantage over the prior art that even over relatively long operation, its dynamic behavior does not vary, since the deposition of dirt particles on the surfaces of the poles and hence in the vicinity of the air gap is prevented. The creation of magnetic bridges by the dirt particles and the resultant stray fluxes at the poles are prevented as well.

Another advantageous feature is that even in the first, critical sections after a hot start, the fuel injection valve according to the invention injects fuel into the intake manifold of an internal combustion engine that is predominantly free of vapor bubbles and hence is readily ignitable.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 shows a fuel injection valve according to the invention; and

FIG. 2 is a fragmentary sectional view taken along the plane II—II of FIG. 1.

DESCRIPTION OF THE PREFERRED EMBODIMENT

The fuel injection valve shown in FIGS. 1 and 2 for a fuel injection system of a mixture-compressing internal combustion engine having externally supplied ignition has a valve housing 1, a stepped housing bore 2 which has a first shoulder 3 (see FIG. 2) on which a base plate 4 rests. Protruding into the central recess 5 of the base plate 4 are a first pole piece 7, with a first bent pole 8, and a second pole piece 9, with a second bent pole 10. The poles 8 and 10, which are oriented toward one another, form a pole air gap 11 between them and are magnetically partly bridged by a first permanent magnet 12. Inside the housing bore 2, a first magnet coil 13 is disposed on the first pole piece 7 and a second magnet coil 14 is disposed on the second pole piece 9, a portion of the coils 13 and 14 being located above the poles 8, 10 and above the permanent magnet 12.

In the regions of the pole pieces 7, 9 remote from the poles 8, 10, there are two magnetic guide bodies 20, 21, the first of which, 20, rests on a flat side of the first pole piece 7 and the second of which, 21, rests on a flat side of the second pole piece 9. The magnetic guide bodies 20, 21 are oriented toward one another; a further permanent magnet 23 may rest between guide bodies 20, 21, with its pole faces. The distance between the first magnetic guide body 20 and the second magnetic guide body 21, which is filled with the second or further permanent magnet 23, is small and therefore functions like a magnetic gap.

Adjoining the region receiving the magnet coils 13, 14, the valve housing 1 has a mouthpiece 26 of small diameter, in which the housing bore 2 continues and receives a valve seat body 27, which via a spacer ring 28 rests on a second shoulder 29 of the housing bore 2 (see FIG. 1). The rim of the mouthpiece 26, in the form of a crimped edge 30, partly encompasses the valve seat body 27 and presses it upwardly toward the second shoulder 29 against the spacer ring 28. In the axial direction, the valve seat body 27 has a continuous flow bore 32, and a fixed valve seat 33 is embodied on the valve seat body 27 so that fuel discharges toward the outside. Remote from the valve seat 33, the flow bore 32 merges with an oblique stop face 34, the diameter of which enlarges in conical fashion up to an adjoining cylindrical guide bore 35. A valve needle 36 protrudes with a large amount of play through the flow bore 32, and a spherically embodied armature 38 made of ferromagnetic material is fixed to one end of the valve needle 36. The armature 38 is slidably supported in the guide bore 35 with slight radial play. Remote from the armature 38, a closing head 39 is formed on the valve needle 36, and is arranged to cooperate with the valve seat 33. Oriented toward the pole pieces 7, 9, which serve as a core, the armature 38 has a flattened portion 40, and when the magnet coils 13, 14 are not excited the armature is attracted by the permanent magnetic field of at least the first permanent magnet 12 toward the poles 8, 10, but an air gap 41 with respect to them remains when the closing head 39 is resting on the valve seat 33. In this position, the spherical armature 38 has lifted away from the oblique stop face 34. The radial guidance of the spherical armature 38 is effected virtually by linear contact on its circumference in the guide bore 36. The delivery of fuel to the flow bore 32 takes place in an annular groove 45 between a step 46 of the valve seat body 27 and the housing bore 2, from whence radial bores 47 lead to the flow bore 32.

As already noted above, when the magnet coils 13, 14 are not excited, the armature 38 is attracted toward the poles 8, 10 by the permanent magnetic field of at least the first permanent magnet 12 and thus holds the closing head 39 on the valve seat 33. Upon corresponding excitation of the magnet coils 13, 14, the permanent magnet flux at the armature 38 is countered by an approximately equally great electromagnetic flux, and as a result the pressure of the fuel engaging the valve needle in the opening direction of the valve is sufficient to lift the closing head 39 from the valve seat 33, so that the armature 38 can execute a stroke movement until it rests on the stop face 34. With the closing head 39 urged outwardly away from the valve seat 33, the fuel flowing to the valve seat 33 at the same time centers the valve needle 36 in the flow bore 32.

As shown in FIG. 1, there are two further openings in the base plate 4 besides the central recess 5, namely an inflow opening 51 and an outflow opening 52. These openings, disposed outside the longitudinal axis of the fuel injection valve and extending axially and spaced apart by the same distance from the longitudinal axis of the valve, discharge for example into a groove 54 that extends radially through the base plate 4, intersecting the central recess 5 and hence the poles 8, 10 as well. The groove 54 is machined into the flat side of the base plate 4 resting on the first shoulder 3 and forms part of a scavenging chamber 55, which is defined on one end by the groove 54 and on the other by the first shoulder 3 of the housing bore 2; the pole air gap 11 and the air gap 41 are located in the approximate center of this chamber 55. The inflow opening 51 serves as the mouth of an inflow line 57, which extends axially within the valve housing 1; the outflow opening 52 serves as the mouth of an outflow line 58, which likewise extends axially within the valve housing 1. The inflow line 57 and the outflow line 58 are embodied as bore, by way of example, and are located inside a plastic jacket 60, which also surrounds the pole pieces 7, 9 and the magnet coils 13, 14.

In the direction remote from the valve seat 33, in an enlargement 62 of the valve housing, the valve housing 1 receives a spacer 63 held in place by a flange 63 on the end of valve housing 1. Between the spacer 63 and the plastic jacket 60, a chamber 64 is provided and into which the outflow line 58 discharges. Secured coaxially in the spacer 63 is a first connection piece 65, extending out of the valve housing 1 and having a central bore 66, which at one end communicates with the chamber 64 and on its other end is provided with a fuel filter 68. The spacer 63 is penetrated not only by the first connection piece 65 but also by a sleeve 70, which preferably is arranged to provide an extension of an communicates with the inflow line 57, parallel to the first connection piece 65, and which on the other end discharges outside the valve housing 1 into a cylindrical collecting conduit 76 embodied inside a second connection piece 75. The collecting conduit 76 forms the bottom of the approximately cup-shaped second connection piece 75, which opens remote from the valve. The cup-shaped second connection piece 75 surrounds the first connection piece 65 over a portion of its length, so that an annular opening 78 extends between the first connection piece 65 and the second connection piece 75. The annular opening 78 is provided with a second fuel filter 79, which is supported on one side on the first connection piece 65 and on the other on the second connection piece 75. The first connection piece 65 and the second connection piece 75 are each surrounded by a respective sealing ring 80, 81. Between the spacer 63 and the axially spaced apart second connection piece 75, there is an extruded plastic coating 83, which surrounds both the first connection piece 65 and the sleeve 70 and in which electrical connections 84 for the magnet coils 13, 14 also extend. The first connection piece 65 opens for example into a fuel return device 91 of the engine, while the second connection piece 75 opens via the annular opening 78 for instance into a fuel supply device 92 of the engine.

The fuel flows through the fuel injection valve in the following manner:

Via the second fuel filter 79, the annular opening 78 and the collecting conduit 76 inside the second connection piece 75, the fuel enters the sleeve 70 from inlet 92 and from there flows via the inflow line 57 and the inflow opening 51 into the scavenging chamber 55. A first flow of fuel leads from there via the annular groove 45, the radial bores 47 and the flow bore 32 to the valve seat 33, while a second portion of the fuel flow flows along the groove 54 to the poles 8, 10. Of this second portion of the fuel flow, a small portion flows through the pole air gap 11, while the majority of it flows through the air gap 41 located between the flattened portion 40 of the armature 38 and the poles 8, 10. In this process, particles of dirt that may have been deposited on the armature 38 or on the poles 8, 10 in the vicinity of the air gap 41 are detached and carried away by the fuel. The pole air gap 11, too, is freed of deposits.

The return flow of the fuel from the scavenging chamber 55 takes place via the outflow opening 52, the outflow line 58, the chamber 64 and the central bore 66 of the first connection piece 65. Via the first fuel filter 68, the fuel leaves the injection valve and reaches the fuel return device via outlet 91.

The invention is not at all restricted to the exemplary embodiment shown; instead, the above-described concept of scavenging of the air gap 41 is applicable to all types of electromagnetically actuatable injection valves. It is particularly applicable, however, to valve constructions in which the magnetic circuit includes at least one permanent magnet, such as described for example in German Offenlegungsschriften Nos. 33 28 467, 33 36 011 and U.S. Pat. No. 4,660,011. Since such magnetic valves of this kind keep a magnetic field in force virtually uninterruptedly during operation, they have a particularly pronounced tendency to form deposits of dirt particles on the pole surfaces.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve for injection of fuel into the intake manifold of a mixture-compressing internal combustion engine having externally supplied ignition, which comprises:

a valve housing (1), at least one pole piece (8, 10), a magnetic coil (13, 14) that upon excitation generates a magnetic flux in said at least one pole piece, a permanent magnet (12) resting on a portion of said at least one pole piece, and an armature (38) connected to a valve closing element (39) and positioned relative thereto with an air gap (41) extending between said armature and said at least one pole piece, a scavenging chamber (55) surrounding said armature and includes said air gap (41) located inside said scavenging chamber, an inflow opening (51) of an inflow line (57) for incoming fuel is spaced from an outflow opening (52) of an outflow line (58) for the fuel discharge and connected with said scavenging chamber in such manner that at least a portion of the fuel flows through the air gap (41) to said overflow opening to carry away any dirt deposits in said air gap.

2. A fuel injection valve as defined by claim 1, which includes a base plate (4) that surrounds an end portion of said at least one pole piece (7, 9), axially extending radial grooves in said base plate that forms a part of said scavenging chamber (55) and connects said inflow opening (51) and said outflow opening (52) with said scavenging chamber.

3. A fuel injection valve as defined by claim 1, in which said inflow line (57) and said outflow line (58) extend parallel to each other over at least a portion of their length and are embodied as elongated bores.

4. A fuel injection valve as defined by claim 3, in which said inflow opening (51) and said outflow opening (52) are spaced apart by the same distance from the air gap (41).

5. A fuel injection valve as defined by claim 1, which includes two pole pieces (7, 9) each of which include an end portion upon which said permanent magnet (12) rests, a magnet coil (13, 14) surrounding each of said two pole pieces, said pole pieces (7, 9) and magnet coils (13, 14) being surrounded by a plastic jacket (60), and said inflow line (57) and said outflow line (58) are located in said plastic jacket (60).

6. A fuel injection valve as defined by claim 1, in which said outflow line (58) connects via a first connection piece (65) with a fuel return connection (91), and said inflow line (57) connects via a second connection piece (75) with a fuel inlet supply line (92).

7. A fuel injection valve as defined by claim 2, in which said outflow line (58) connects via a first connection piece (65) with a fuel return connection (91), and said inflow line (57) connects via a second connection piece (75) with a fuel inlet supply line (92).

8. A fuel injection valve as defined by claim 3, in which said outflow line (58) connects via a first connection piece (65) with a fuel return connection (91), and said inflow line (57) connects via a second connection piece (75) with a fuel inlet supply line (92).

9. A fuel injection valve as defined by claim 4, in which said outflow line (58) connects via a first connection piece (65) with a fuel return connection (91), and said inflow line (57) connects via a second connection piece (75) with a fuel inlet supply line (92).

10. A fuel injection valve as defined by claim 5, in which said outflow line (58) connects via a first connection piece (65) with a fuel return connection (91), and said inflow line (57) connects via a second connection piece (75) with a fuel inlet supply line (92).

11. A fuel injection valve as defined by claim 6, in which said first connection piece (65) is located coaxially inside said second connection piece (75).

12. A fuel injection valve as defined by claim 7, in which said first connection piece (65) is located coaxially inside said second connection piece (75).

13. A fuel injection valve as defined by claim 8, in which said first connection piece (65) is located coaxially inside said second connection piece (75).

14. A fuel injection valve as defined by claim 9, in which said first connection piece (65) is located coaxially inside said second connection piece (75).

15. A fuel injection valve as defined by claim 10, in which said first connection piece (65) is located coaxially inside said second connection piece (75).

16. A fuel injection valve as defined by claim 2, which includes two pole pieces (7, 9), each of which includes an end portion upon which said permanent magnet (12) rests, a magnet coil (13, 14) surrounding each of said two pole pieces, said pole pieces (7, 9) and magnet coils (13, 14) being surrounded by a plastic jacket (60), and said inflow line (57) and said outflow line (58) are located in said plastic jacket (60).

17. A fuel injection valve as defined by claim 16, in which said outflow line (58) connects via a first connection piece (65) with a fuel return connection (91), and said inflow line (57) connects via a second connection piece (75) with a fuel inlet supply line (92).

* * * * *